US010137683B2

(12) United States Patent
Fujii

(10) Patent No.: US 10,137,683 B2
(45) Date of Patent: Nov. 27, 2018

(54) LIQUID DISCHARGE HEAD SUBSTRATE, LIQUID DISCHARGE HEAD, AND RECORDING APPARATUS

(71) Applicant: CANON KABUSHIKI KAISHA, Tokyo (JP)

(72) Inventor: Yasuo Fujii, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/490,668

(22) Filed: Apr. 18, 2017

(65) Prior Publication Data

US 2017/0305154 A1 Oct. 26, 2017

(30) Foreign Application Priority Data

Apr. 22, 2016 (JP) ..... 2016-086548

(51) Int. Cl.
*B41J 2/045* (2006.01)
*B41J 2/14* (2006.01)

(52) U.S. Cl.
CPC ..... *B41J 2/0455* (2013.01); *B41J 2/0458* (2013.01); *B41J 2/04541* (2013.01); *B41J 2/04548* (2013.01); *B41J 2/14016* (2013.01); *B41J 2/14072* (2013.01); *B41J 2202/13* (2013.01)

(58) Field of Classification Search
CPC .. B41J 2/0455; B41J 2/14016; B41J 2/04548; B41J 2202/13; B41J 2/14088
See application file for complete search history.

(56) References Cited

U.S. PATENT DOCUMENTS 6,302,504 B1 * 10/2001 Imanaka ..... B41J 2/04506 347/12
9,227,401 B2 1/2016 Fujii
2010/0165053 A1 * 7/2010 Bergstedt ..... B41J 2/04515 347/62

FOREIGN PATENT DOCUMENTS

JP 2009-166257 A 7/2009

* cited by examiner

*Primary Examiner* — Geoffrey S Mruk
(74) *Attorney, Agent, or Firm* — Canon USA, Inc., IP Division

(57) ABSTRACT

A liquid discharge head substrate includes a first heater row including a plurality of heaters arranged in a first direction, a first transistor configured to drive a first heater of the plurality of heaters, and a second transistor configured to drive the first heater. The first heater is arranged between the first transistor and the second transistor in a second direction crossing the first direction.

20 Claims, 20 Drawing Sheets

LIQUID DISCHARGE HEAD SUBSTRATE, LIQUID DISCHARGE HEAD, AND RECORDING APPARATUS

BACKGROUND

Field

Aspects of the present invention generally relate to a liquid discharge head substrate such as an ink jet recording head substrate, to a liquid discharge head including the substrate, and to a recording apparatus including the substrate. For example, aspects of the present invention relate to a liquid discharge head substrate including a heater serving as an element that generates energy for discharging ink, to a liquid discharge head including the substrate, and to a recording apparatus including the substrate.

Description of the Related Art

As general liquid discharge heads, liquid discharge heads that discharge liquid by using heaters are known. In recent years, there has been a growing demand for further enhancing driving performance of liquid discharge heads and for downsizing liquid discharge heads.

Japanese Patent Application Laid-Open No. 2009-166257 discusses a technique of applying different voltages in accordance with a size of a discharged droplet using a single power supply whereby a higher driving performance and downsizing of a liquid discharge head is achieved. Japanese Patent Application Laid-Open No. 2009-166257 discusses a configuration, in which voltage is adjusted for each heater using a single power supply, for achieving downsizing of a liquid discharge head. However, Japanese Patent Application Laid-Open No. 2009-166257 fails to discuss in detail arrangement of a heater and a driving circuit of the liquid discharge head for achieving the downsizing.

SUMMARY

According to an aspect of the present invention, a liquid discharge head substrate includes a first heater row including a plurality of heaters arranged in a first direction in a plan view, and a first transistor and a second transistor configured to supply current to a first heater of the plurality of heaters, wherein the first heater and the first transistor are connected in series on an electric path between first wiring to which a first potential is supplied and second wiring to which a second potential different from the first potential is supplied, wherein the first heater and the second transistor are connected in series on an electric path between the first wiring and the second wiring, and wherein the first heater is arranged between the first transistor and the second transistor in a second direction crossing the first direction in the plan view.

According to another aspect of the present invention, a liquid discharge head includes a plurality of nozzles and a liquid discharge head substrate facing the plurality of nozzles, wherein the liquid discharge head substrate includes a first heater row including a plurality of heaters arranged in a first direction in a plan view, and a first transistor and a second transistor configured to supply current to a first heater of the plurality of heaters, wherein the first heater and the first transistor are connected in series on an electric path between first wiring to which a first potential is supplied and second wiring to which a second potential different from the first potential is supplied, wherein the first heater and the second transistor are connected in series on an electric path between the first wiring and the second wiring, and wherein the first heater is arranged between the first transistor and the second transistor in a second direction crossing the first direction in the plan view.

According to yet another aspect of the present invention, a recording apparatus includes a liquid discharge head including a plurality of nozzles and a liquid discharge head substrate, and an ink tank attached to the liquid discharge head. The liquid discharge head substrate includes a first heater row including a plurality of heaters arranged in a first direction in a plan view, and a first transistor and a second transistor configured to supply current to a first heater of the plurality of heaters, wherein the first heater and the first transistor are connected in series on an electric path between first wiring to which a first potential is supplied and second wiring to which a second potential different from the first potential is supplied, wherein the first heater and the second transistor are connected in series on an electric path between the first wiring and the second wiring, and wherein the first heater is arranged between the first transistor and the second transistor in a second direction crossing the first direction in the plan view.

Further features of aspects of the present invention will become apparent from the following description of exemplary embodiments with reference to the attached drawings.

BRIEF DESCRIPTION OF THE DRAWINGS

FIG. 2-1 is an enlarged view of a part of the liquid discharge head substrate illustrated in FIG. 1.

FIG. 2-2 is a circuit diagram illustrating a part of the liquid discharge head substrate illustrated in FIG. 2-1.

FIGS. 2-3A to 2-3E are cross-sectional views of the liquid discharge head substrate respectively taken along dotted lines A-B, B-C, C-D, D-E, and E-F in FIG. 2-1.

FIG. 3 is a diagram illustrating an example of a liquid discharge head substrate according to a second exemplary embodiment of the present invention.

FIG. 8-1 is an enlarged view of a part of the liquid discharge head substrate illustrated in FIG. 7.

FIG. 8-2 is a circuit diagram illustrating the part of the liquid discharge head substrate illustrated in FIG. 8-1.

FIG. 12-1 is an enlarged view of a part of the liquid discharge head substrate illustrated in FIG. 11.

FIG. 12-2 is a circuit diagram illustrating the part of the liquid discharge head substrate illustrated in FIG. 12-1.

FIG. 14-1 is an enlarged view of a part of the liquid discharge head substrate illustrated in FIG. 13.

FIG. 14-2 is a circuit diagram illustrating the part of the liquid discharge head substrate illustrated in FIG. 14-1.

DESCRIPTION OF THE EMBODIMENTS

In the present specification, a transistor includes a source region, a drain region, and a gate electrode. A configuration in which at least one of the source region and the drain region is used in common is regarded as a single transistor.

Exemplary embodiments of the present invention are described below with reference to the drawings.

Figure 1:
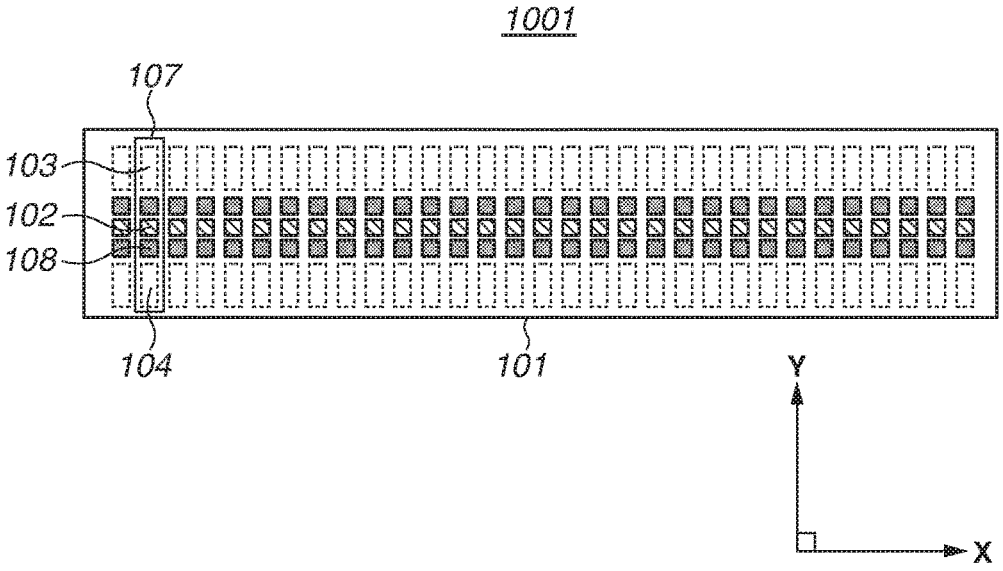
FIG. 1 illustrates an example of a liquid discharge head substrate according to a first exemplary embodiment of the present invention.

FIG. 1 is a plan view illustrating one example of a liquid discharge head substrate 1001 forming a liquid discharge head according to a first exemplary embodiment of the present invention.

The liquid discharge head substrate 1001 includes a substrate 101, a first heater row including a plurality of heaters 102 arranged on the substrate 101 along a first direction (an X-direction in FIG. 1) in the plan view. Furthermore, driving circuits are provided that are arranged along the first direction and each of which drives a corresponding one of the heaters 102. Liquid is supplied to the liquid discharge head through a plurality of supply ports 108. The plurality of supply ports 108 is arranged along the first direction. Thus, the first heater row extends along the first direction, and the plurality of driving circuits is arranged along the first direction. In an example described in the present exemplary embodiment, the driving circuits each include a transistor 103 and a transistor 104.

The heaters 102 are each connected to the transistor 103 and the transistor 104. When the transistor 103 and the transistor 104 are driven, current is supplied to the heater 102 so that ink is discharged. The plurality of heaters 102 is arranged along the X-direction (first direction) in FIG. 1. Each pair of the transistor 103 and the transistor 104 is arranged such that the heater 102 is located between the transistor 103 and the transistor 104 in a Y-direction (second direction). In this example, the second direction is orthogonal to the first direction. However, aspects of the present invention are not limited to this.

Figures 1, 2:
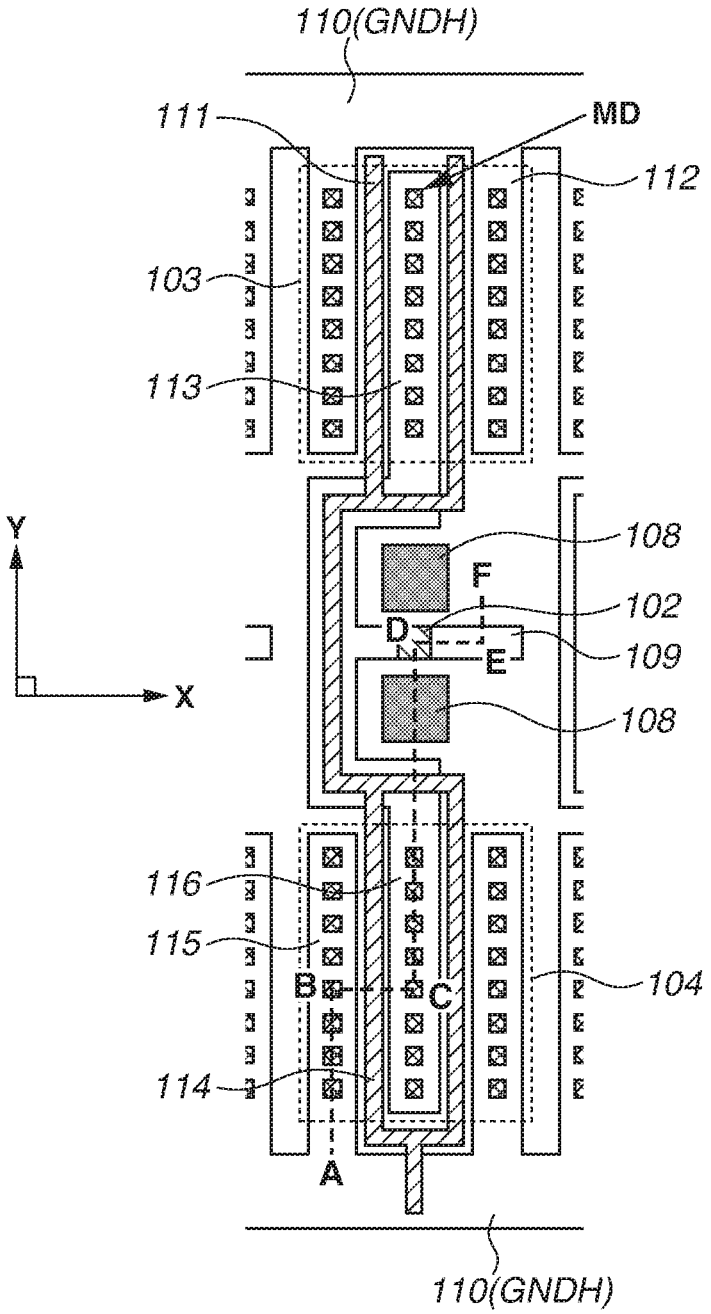
Figure 2:
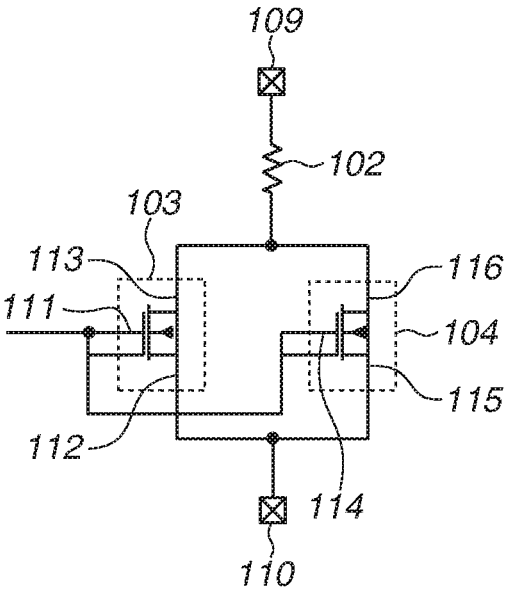

FIG. 2-1 is a plan view illustrating a layout around the heater 102 in the liquid discharge head substrate 1001, in an enlarged part 107 in FIG. 1. FIG. 2-2 is a circuit diagram illustrating a part of the liquid discharge head substrate illustrated in FIG. 2-1. FIGS. 2-3A to 2-3E are cross-sectional views of the liquid discharge head substrate respectively taken along dotted lines A-B, B-C, C-D, D-E, and E-F in FIG. 2-1.

In FIG. 2-1, the supply ports 108 are each a hole through which ink is supplied from a back surface of the substrate 101. As illustrated in FIG. 2-1, the supply ports 108 are formed between the transistor 103 and the transistor 104 in the second direction (Y-direction) in the plan view.

In this example, the transistor 103 and the transistor 104 are each an N-type metal-oxide semiconductor (NMOS) transistor. The heater 102 has one end connected to the transistors 103 and 104 through wiring and has the other end connected to wiring 109 (VH) that is connected to a power supply and is supplied with a first potential.

As illustrated in FIG. 2-2, the heater 102 and the transistor 103 are connected in series on an electric path between the wiring 109 and wiring 110 that is supplied with a second potential (a ground potential in this example). Similarly, the heater 102 and the transistor 104 are connected in series on an electric path between the wiring 109 and the wiring 110. In this example, the transistor 103 and the transistor 104 are connected in parallel on the electric path between the wiring 109 and the wiring 110.

More specifically, the heater 102 has a first terminal connected to the wiring 109 (VH). The wiring 109 (VH) is connected the power supply that applies voltage of about 32 V for example. The heater 102 further has a second terminal connected to drain wiring 113 of the transistor 103 and to drain wiring 116 of the transistor 104. Source wiring 112 of the transistor 103 and source wiring 115 of the transistor 104 are each connected to the wiring 110 (GNDH) at the ground level.

The source wiring 112 and the drain wiring 113 may be respectively connected to a source region and a drain region of the transistor 103 directly, or indirectly via another wiring. Similarly, the source wiring 115 and the drain wiring 116 may be respectively connected to a source region and a drain region of the transistor 104 directly, or indirectly via another wiring. Similarly, the source wiring and the drain wiring may each be connected to the wiring 109 and the wiring 110 directly, or indirectly via another wiring.

The transistors 103 and 104 each have a channel width direction extending along the second direction.

A gate 111 of the transistor 103 and a gate electrode 114 of the transistor 104 are connected to a control circuit (not illustrated) through the same wiring.

As illustrated in FIGS. 2-3A to 2-3E, the transistor 104 includes a semiconductor region 127 (N-type semiconductor region), having a first conductivity type, as the source region and the drain region on the substrate 101. A gate electrode 114 is provided over a semiconductor region 126 (P-type semiconductor region), having a second conductivity type, on the substrate 101 with a gate insulating film in between.

An interlayer film 133 is provided on the gate electrode 114, an element isolation region 125, and the semiconductor region 127. The source wiring 115 is connected to the source region via a contact 124 provided to the interlayer film 133. The drain wiring 116 is connected to the drain region via a contact provided to the interlayer film 133.

In an example of the present invention, a single source region or drain region includes a plurality of the contacts 124. However, the present exemplary embodiment is not limited to this. For example, an overlapping portion between the semiconductor region (the source region or the drain region) and the wiring (the source wiring or the drain wiring) may be provided with a single contact. The contact has a shape corresponding to the overlapping portion, and is elongated in one direction (the Y-direction in this example) in the plan view in FIG. 2-1.

The configuration of the transistor 104 described above may be similarly applied to the transistor 103.

In an example illustrated in FIGS. 2-3A to 2-3E, the source wiring 112 and 115 and the drain wiring 113 and 116 are each formed by a stacked layer including the first conductive layer 130 and the second conductive layer 131. The heater 102 includes the second conductive layer 131 but does not include the first conductive layer 130. For example, the first conductive layer 130 may be made of aluminum. A protective film 128 is formed on the first conductive layer 130, for protecting the liquid discharge head substrate 1001 against moisture and the like. For example, the protective film 128 may be an insulating film.

Current (heater current) flowing in a heater can be increased by increasing the channel width of the transistor 103 and the transistor 104. Thus, a larger droplet can be discharged from the liquid discharge head including the liquid discharge head substrate.

In the transistor 103 and the transistor 104, energy required for causing a predetermine amount of current to flow in the heater 102 can be reduced by reducing resistance in a current path between the heater 102 and the drain region. However, a larger channel width of the transistors, designed for causing a large amount of current to flow in the heater, results in a larger distance between the heater 102 and a connection portion to be connected to the drain wiring in the drain region along the current path. As the resistance in the current path increases, the heater current decreases.

Thus, a larger transistor, designed to achieve a larger heater current, involves a larger length of the current path between the heater 102 and the portion to be connected to the drain wiring with the contact in the drain region. As a result, the heater current value does not increase in proportion to the increase in the size of the transistor. All things considered, a larger amount of energy needs to be supplied for generating a desired amount of heat with the heater, resulting in lowered driving efficiency.

In the drain region, the current path is the longest and involves the largest resistance between the heater 102 and a portion that is connected to the drain wiring with the contact and is farthest from the heater 102 (hereinafter, referred to as a most distant end of the drain from the heater). Thus, the heater current value can be effectively increased by increasing the channel width of the transistor without increasing the length of this current path, whereby a liquid discharge head substrate with smaller power consumption and a smaller size can be provided. For example, in the liquid discharge head substrate illustrated in FIG. 2-1, the drain of the transistor 103 has a most distant end MD from the heater 102.

In the present exemplary embodiment, the driving circuit includes the transistor 103 and the transistor 104 that are arranged on both side of the heater 102 in the second direction, crossing the first direction. This configuration features a smaller area occupied by the heater and the driving circuit compared with the configuration where the driving circuit only includes a transistor on one side of the heater 102 in the second direction, when the amount of the current to be supplied is the same.

More specifically, the configuration according to the present exemplary embodiment has a shorter current path between the heater and the most distant end of the drain from the heater, compared with the configuration according to a comparative example with the same channel width. As described above, a longer current path involves a larger resistance, whereby the heater current does not increase in proportion to an increase in the channel width. Thus, the amount of the heater current decreases as the length of the current path to the most distant end of the drain from the heater increases in the liquid discharge head substrate, when the channel width is the same.

Thus, the layout having the transistors arranged such that the heater is located between the transistors can achieve a smaller liquid discharge head substrate, compared with the layout having the transistor serving as the driving circuit provided only on one side of the heater, when the amount of the current to be flowing in the heater is the same. The liquid discharge head substrate according to the present exemplary embodiment can achieve a larger heater current compared with the configuration according to the comparative example, when the driving energy is the same, and thus can achieve smaller power consumption.

In FIG. 2-1, the pair of the transistor 103 and the transistor 104 are arranged such that the heater is located between the transistor 103 and the transistor 104, in the Y-direction. Thus, a short current path can be achieved between the heater and the most distant end of the drain wiring 113 from the heater and between the heater and the most distant end of the drain wiring 116 from the heater. Thus, the resistance in these portions on the current paths can be reduced compared with that in the configuration where the driving circuit is provided only on one side of the heater. Thus, the transistor sizes of the transistors 103 and 104 can be made small, whereby the liquid discharge head substrate can be downsized.

As described above, the liquid discharge head substrate can be downsized with the driving circuit divided to be arranged on both sides of the heater in the second direction crossing the first direction in which the heater row extends. Furthermore, the liquid discharge head substrate with a more efficient driving circuit can be provided. All things considered, the liquid discharge head substrate downsized with a favorable layout of the heater and the driving circuit as well as the liquid discharge head or the recording apparatus including such a liquid discharge head substrate can be provided.

In the configuration described above, the transistors 103 and 104 each have the drain connected to the heater 102. However, the liquid discharge head substrate according to an aspect of the present invention is not limited to this. For example, a configuration in which the source of one of the transistors 103 and 104 or both is connected to the heater 102 may be employed. Which configuration is employed may be determined in accordance with a relationship between a potential supplied to the first terminal of the heater 102 not connected to the transistor and a potential supplied to the terminal of the transistor not connected to the heater, the conductivity type of the transistors 103 and 104, or the like.

Figures 2, 3, 3A:
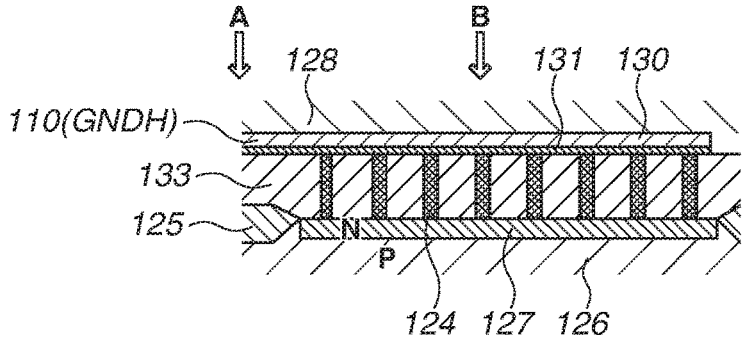
Figures 2, 3, 3B:
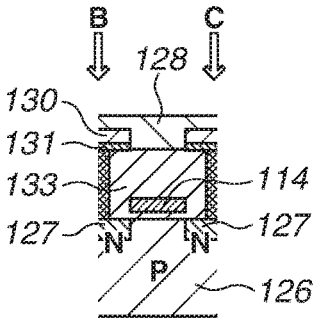
Figures 2, 3, 3C:
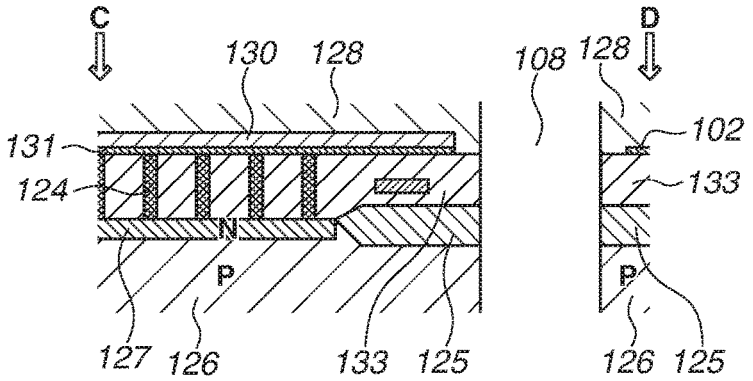
Figures 2, 3, 3D:
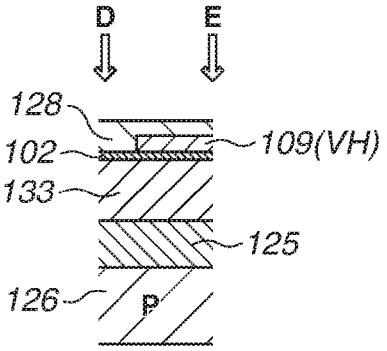
Figures 2, 3, 3E:
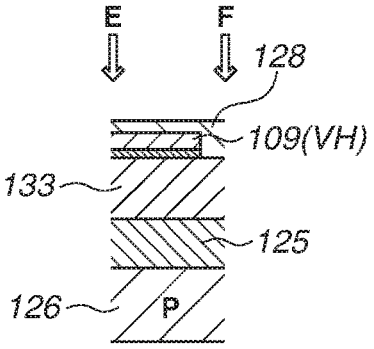
Figure 3:
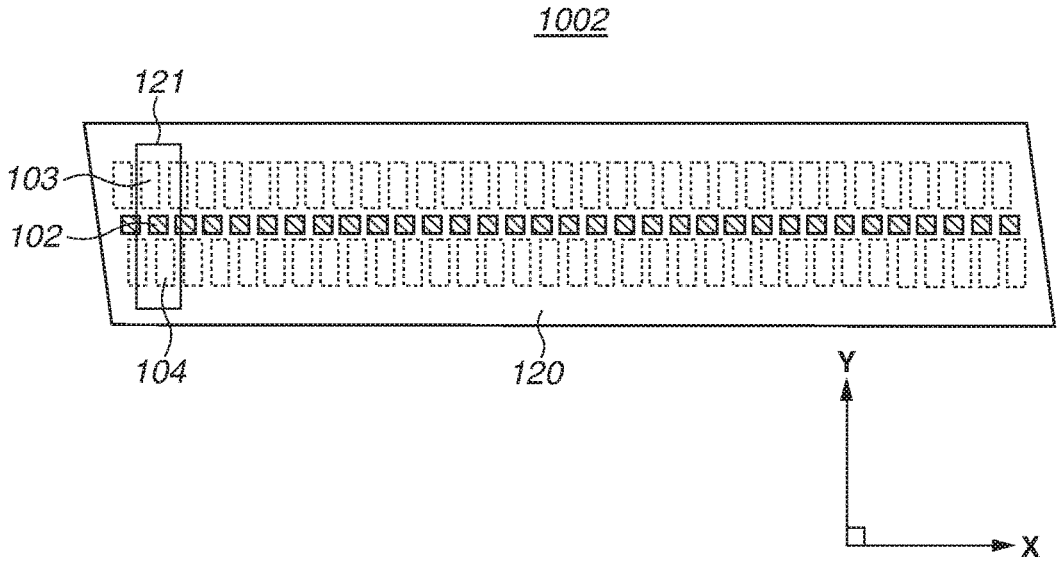

FIG. 3 is a plan view of a liquid discharge head substrate 1002 with a nozzle forming a liquid discharge head according to a second exemplary embodiment of the present invention (the supply ports 108 are omitted). The second exemplary embodiment is different from the first exemplary embodiment, in which the transistor 103 and the transistor 104 are linearly arranged in the Y-direction (second direction), in that the transistor 104 is arranged with deviation with respect to the transistor 103 in the X-direction (first direction) on a substrate 120. In FIG. 3, the substrate 120 may have a shape with four main sides including a pair of parallel sides. The shape includes an acute angle between one of the pair of parallel sides and one of the other two sides, and an obtuse angle between one of the pair of parallel sides and the other one of the other two sides. Alternatively, the shape includes an acute angle between an extension line of one of the pair of parallel sides and an extension line of one of the other two sides, and an obtuse angle between an extension line of one of the pair of parallel sides and an extension line of the other one of the other two sides. For example, the substrate 120 may have a parallelogram shape. In this exemplary embodiment, a difference from the first exemplary embodiment is described, and a description on the configuration and the effect that are the same as those in the first exemplary embodiment is omitted.

Figure 4:
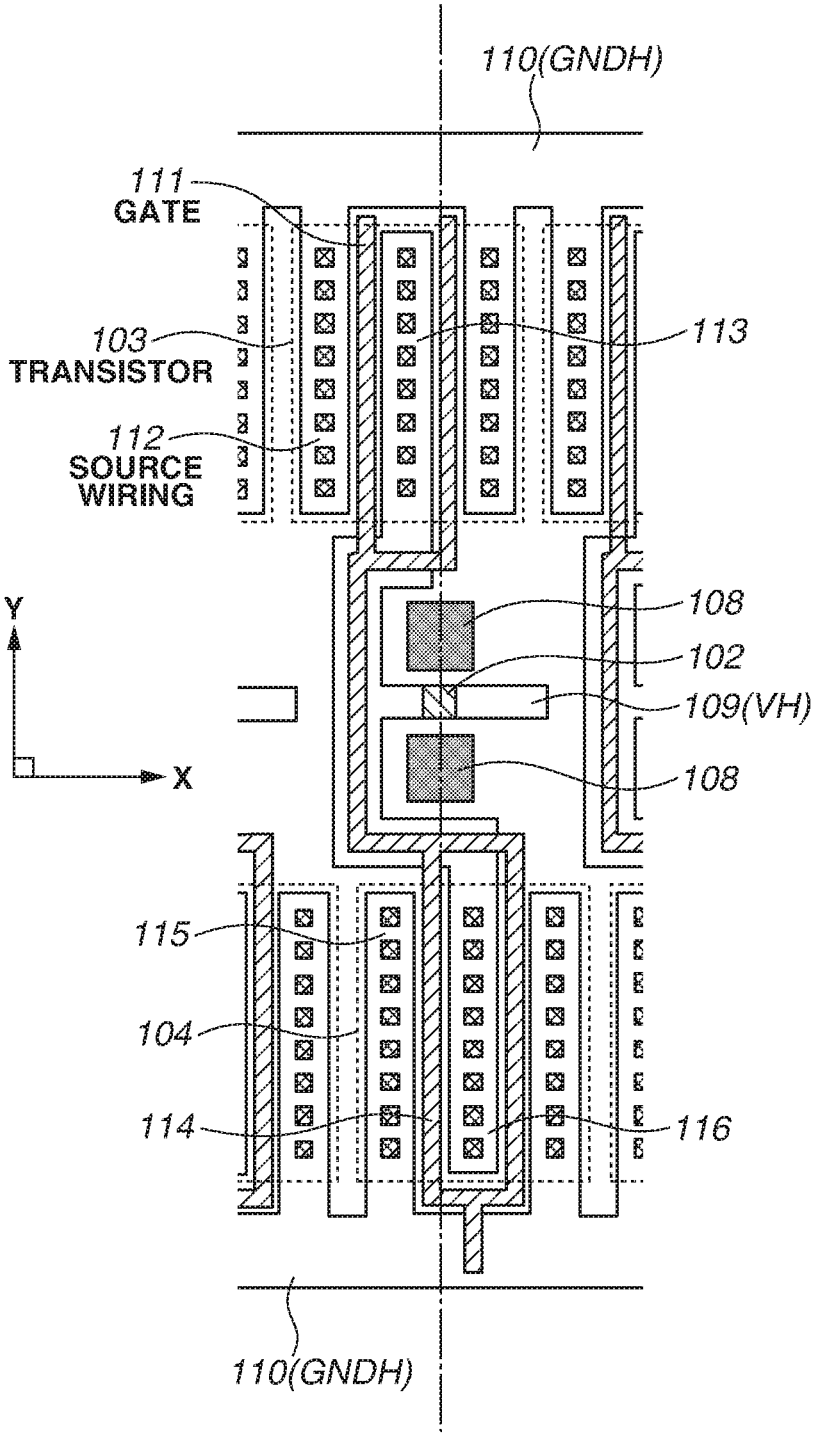
FIG. 4 is an enlarged view of a part of the liquid discharge head substrate illustrated in FIG. 3.

FIG. 4 is a plan view illustrating a layout around the heater 102 of the liquid discharge head substrate 1002 in an enlarged part 121 in FIG. 3. The circuit diagram is the same as that in FIG. 2-2. Thus, the heater 102 is arranged between the transistor 103 and the transistor 104 in the second direction (the Y-direction in this example) orthogonal to the first direction (the X-direction in this example). With this configuration, a liquid discharge head substrate with a smaller size can be provided. Furthermore, a liquid discharge head substrate with smaller power consumption can be provided.

As described above, the substrate 120 has a parallelogram shape. Thus, the (linear) arrangement of the transistor 103 and the transistor 104 in the Y-direction as illustrated in FIG. 2-1 results in dead spaces, where no driving circuit or heater can be formed, provided at ends of the substrate. On the other hand, in the present exemplary embodiment, the transistor 103 is arranged at a position deviated with respect to the transistor 104 in the first direction (X-direction). In this way, the dead spaces can be reduced and the substrate 120 can be more effectively used. Consequently, further downsizing of the liquid discharge head and cost reduction can be achieved.

Figure 5:
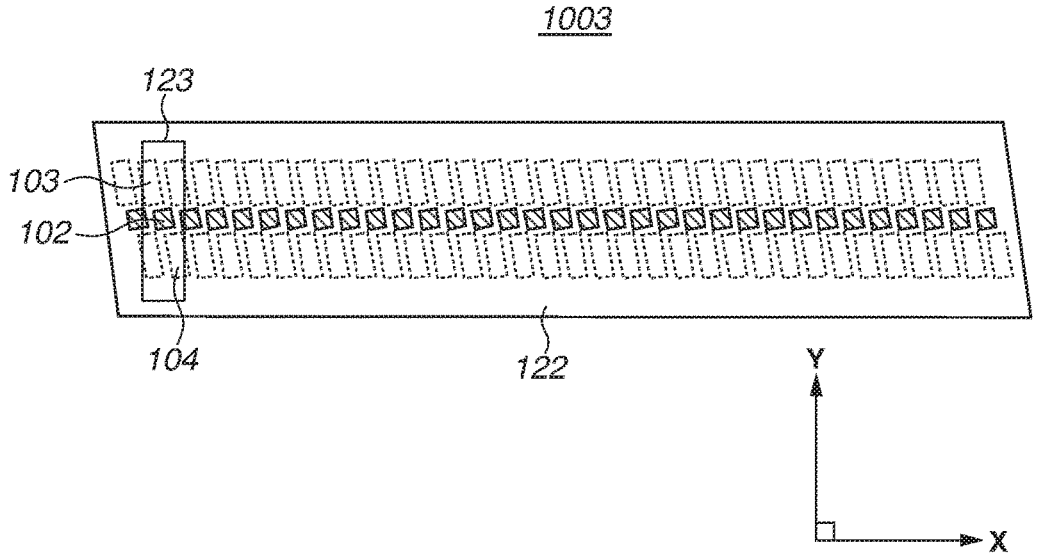
FIG. 5 is a diagram illustrating an example of a liquid discharge head substrate according to a third exemplary embodiment of the present invention.

FIG. 5 is a plan view of a liquid discharge head substrate 1003 with a nozzle forming a liquid discharge head according to a third exemplary embodiment of the present invention (the supply ports 108 are omitted). The third exemplary embodiment is different from the first exemplary embodiment in that the transistor 103 and the transistor 104 on a substrate 122 are rotated about the heater 102 from the direction orthogonal to the X-direction. Thus, in this example, the second direction in which the transistor 103 and the transistor 104 are arranged such that the heater 102 is located between the transistor 103 and the transistor 104 is not orthogonal to the first direction (X-direction). The substrate 122 may have a shape with four main sides as in the second exemplary embodiment. For example, the substrate 122 may have a parallelogram shape. In this exemplary embodiment, a difference from the first exemplary embodiment is described, and a description on the configuration and the effect that are the same as those in the first exemplary embodiment is omitted.

Figure 6:
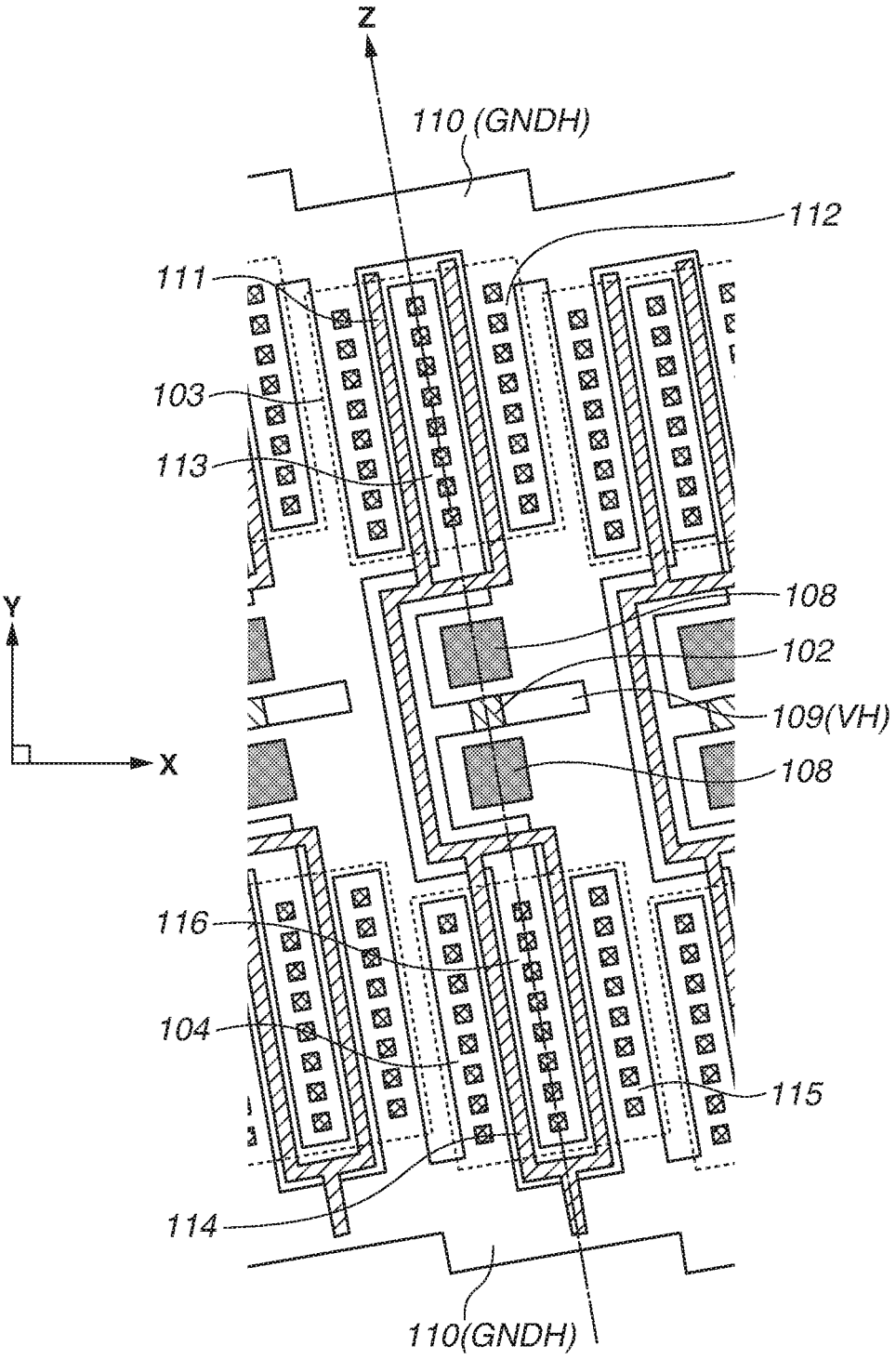
FIG. 6 is an enlarged view of a part of the liquid discharge head substrate illustrated in FIG. 5.

FIG. 6 is a plan view illustrating a layout around the heater 102 of the liquid discharge head substrate 1003 in an enlarged part 123 in FIG. 5. The circuit diagram is the same as that in FIG. 2-2. As illustrated in FIG. 6, the heater 102 is arranged between the transistors 103 and 104 in a Z-direction (third direction) crossing the Y-direction (second direction). When the substrate 122, having the parallelogram shape, includes a pair of sides in parallel with the X-direction, the Z-direction crosses the X-direction (first direction). An angle (acute angle) between the Y-direction and the Z-direction is smaller than an angle (acute angle) between the X-direction and the Z-direction. With this configuration, the liquid discharge head substrate with a more efficient driving circuit can be provided.

The transistors 103 and 104 are arranged such that the heater 102 is located between that transistors 103 and 104, in the Z-direction, whereby the dead space where no driving circuit or heater can be formed can be reduced even when the substrate 122 has the parallelogram shape. Thus, the substrate 122 can be effectively used. The substrate 122 can be most effectively used when the Z-direction is in parallel with the pair of sides of the substrate 122, having the parallelogram shape, not in parallel with the X-direction. Thus, further downsizing and cost reduction of the liquid discharge head can be achieved.

Figure 7:
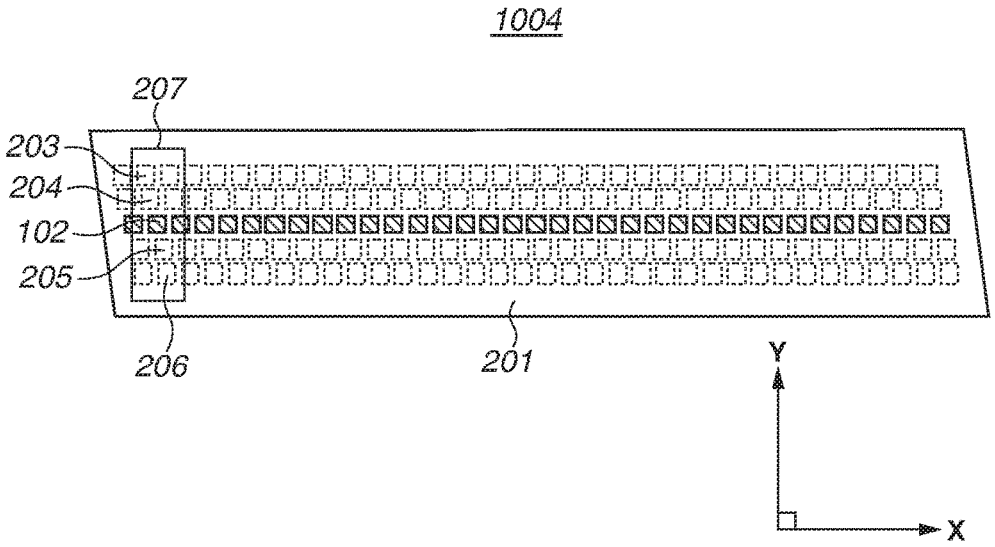
FIG. 7 is a diagram illustrating an example of a liquid discharge head substrate according to a fourth exemplary embodiment of the present invention.

FIG. 7 is a plan view of a liquid discharge head substrate 1004 with a nozzle forming a liquid discharge head according to a fourth exemplary embodiment of the present invention (the supply ports 108 are omitted). The fourth exemplary embodiment is different from the second exemplary embodiment in that the transistor 103 is divided into a transistor 203 and a transistor 204, the transistor 104 is divided into a transistor 205 and a transistor 206, and the divided transistors are arranged with deviation from each other in the X-direction on the substrate 201. In the present exemplary embodiment, the transistors 203 to 206 each include a transistor.

More specifically, in the present exemplary embodiment, the transistor 204 is electrically connected to the transistor 203, and the transistor 206 is electrically connected to the transistor 205. The transistor 204 is arranged between the transistor 203 and the heater 102. The transistor 205 is arranged between the transistor 206 and the heater 102.

The transistor 204 has a gate electrode, a source region, and a drain region respectively extending from a gate electrode, source region, and a drain region of the transistor 203. The transistor 205 has a gate electrode, a source region, and a drain region respectively extending from a gate electrode, source region, and a drain region of the transistor 206.

The substrate 201 may have a shape with four main sides as in the second or the third exemplary embodiment. For example, the substrate 201 may have a parallelogram shape. In this exemplary embodiment, a difference from the second exemplary embodiment is described, and a description on the configuration and the effect that are the same as those in the second exemplary embodiment is omitted.

Figures 1, 8:
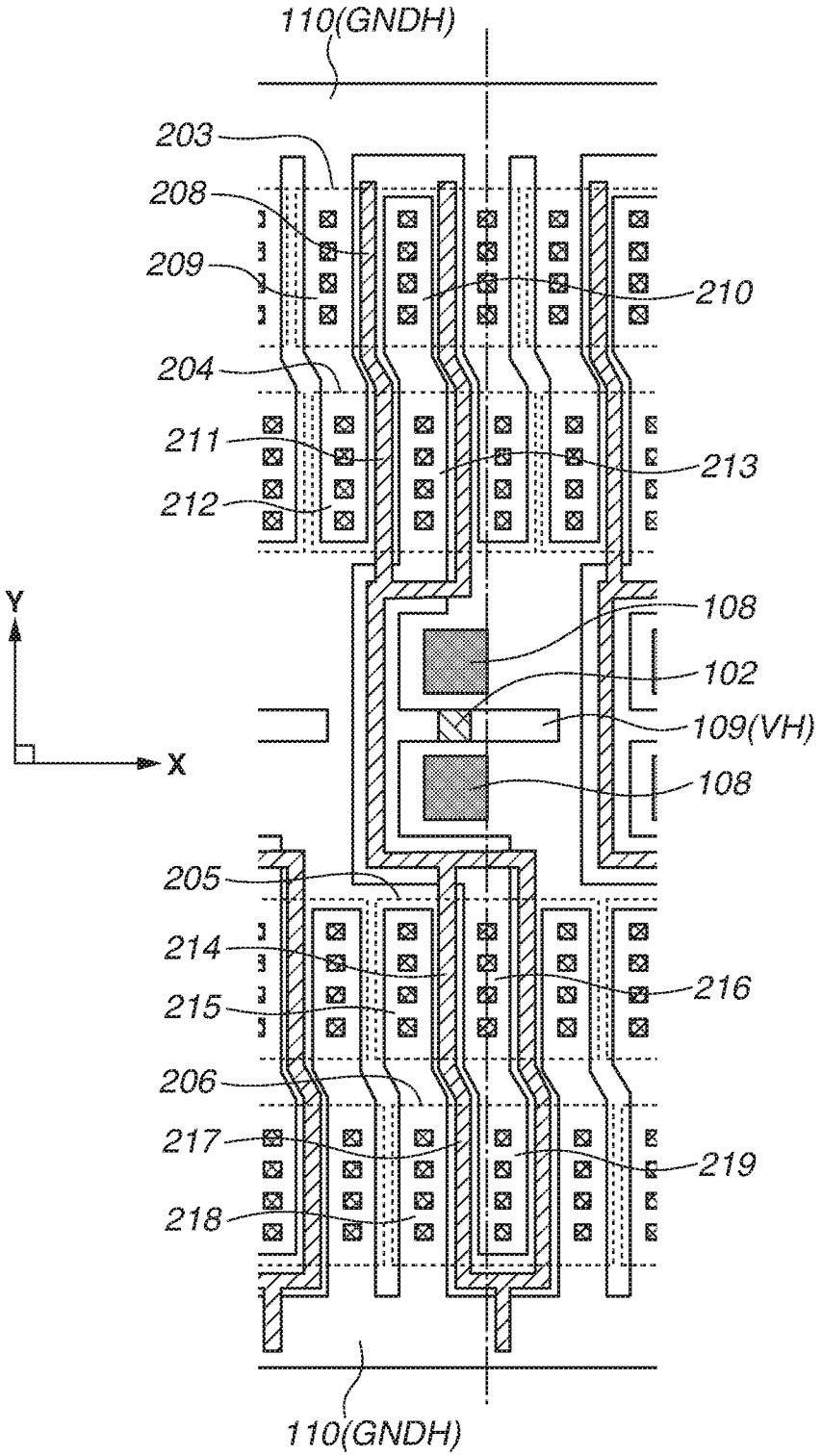
Figures 2, 8:
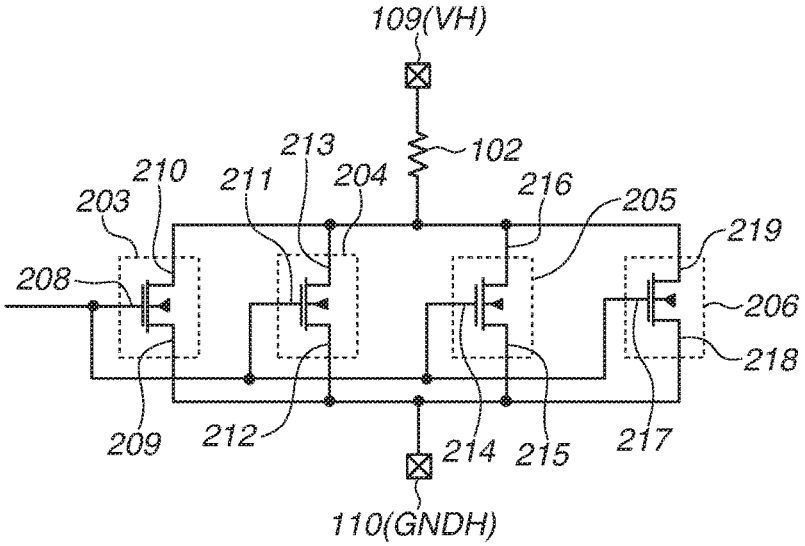

FIG. 8-1 is a plan view illustrating a layout around the heater 102 of the liquid discharge head substrate 1004 in an enlarged part 207 in FIG. 7.

FIG. 8-2 is a circuit diagram illustrating a part of the liquid discharge head substrate 1004 illustrated in FIG. 8-1. The transistors 203 to 206 each include a source region and a drain region, and respectively include gates 208, 211, 214, and 217. The transistors 203 to 206 each have the source region connected to corresponding source wiring 209, 212, 215, or 218. The transistors 203 to 206 each have the drain region connected to corresponding drain wiring 210, 213, 216, or 219.

As in the first to the third exemplary embodiments, the source region and the drain region may be respectively connected to the source wiring and the drain wiring via another wiring.

In FIG. 8-1, the transistor 203 is arranged at a position deviated with respect to the transistor 204 in the X-direction (first direction). The transistor 206 is arranged at a position deviated with respect to the transistor 205 in the X-direction (first direction).

The source regions and the drain regions of the transistors 203 and 204 are continuously formed and extend in the Y-direction while being deviated from each other in the X-direction. Similarly, the source regions and the drain regions of the transistors 205 and 206 are continuously formed and extend in the Y-direction while being deviated from each other in the X-direction.

The liquid discharge head substrate according to the present exemplary embodiment has a configuration in which the driving circuit is divided to be arranged on both sides of the heater, as in the first exemplary embodiment. Thus, a current path with a small resistance can be achieved between the heater 102 and the most distant end of the drain region of the transistor 203 from the heater 102. Furthermore, a current path with a small resistance can be achieved between the heater 102 and the most distant end of the drain region of the transistor 206 from the heater 102. With the driving circuit thus divided to be arranged on both sides of the heater, the liquid discharge head substrate can be downsized. Furthermore, the liquid discharge head substrate with a more efficient driving circuit can be provided.

The transistor 203 is arranged at a position deviated with respect to the transistor 204 in a direction opposite to the first direction (X-direction). The transistor 206 is arranged with deviation with respect to the transistor 205 in the first direction (X-direction). Thus, the space of the substrate 201 can be effectively used with the dead space on the substrate 201 reduced as in the second and the third exemplary embodiments. All things considered, further downsizing and cost reduction of the liquid discharge head can be achieved.

Figure 9:
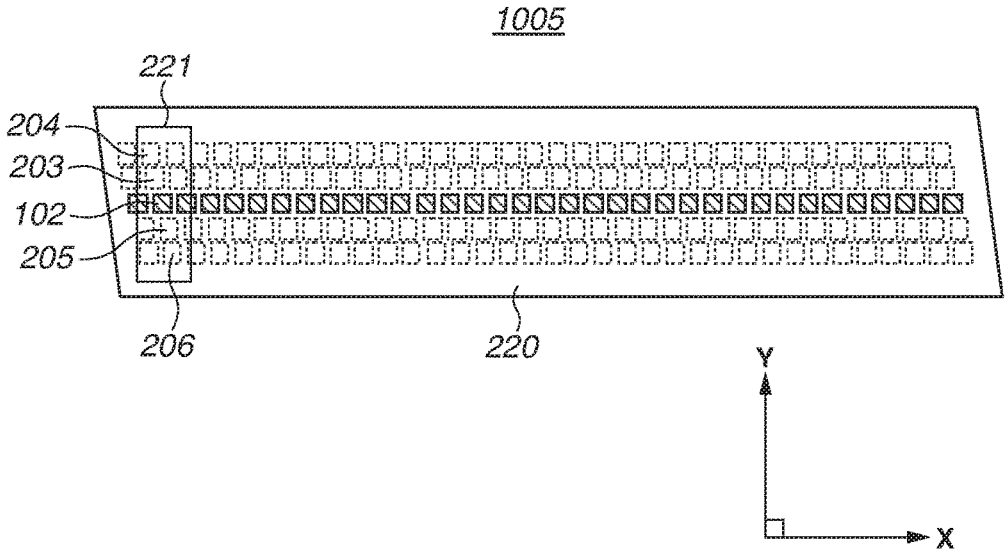
FIG. 9 is a diagram illustrating an example of a liquid discharge head substrate according to a fifth exemplary embodiment of the present invention.

FIG. 9 is a plan view of a liquid discharge head substrate 1005 with a nozzle forming a liquid discharge head according to a fifth exemplary embodiment of the present invention. The present exemplary embodiment is different from the fourth exemplary embodiment in that the transistor 203, the transistor 204, the transistor 205, and the transistor 206 are arranged along the Z-direction (third direction) crossing the Y-direction (second direction) on a substrate 220.

In this exemplary embodiment, a difference from the fourth exemplary embodiment is described, and a description on the configuration and the effect that are the same as those in the fourth exemplary embodiment is omitted. The substrate 220 may have a shape with four main sides as in the second to the fourth exemplary embodiments. For example, the substrate 220 may have a parallelogram shape. When the substrate 220, having the parallelogram shape, includes a pair of sides in parallel with the X-direction, the Z-direction crosses the X-direction (first direction). An angle (acute angle) between the Y-direction and the Z-direction is smaller than an angle (acute angle) between the X-direction and the Z-direction.

Figure 10:
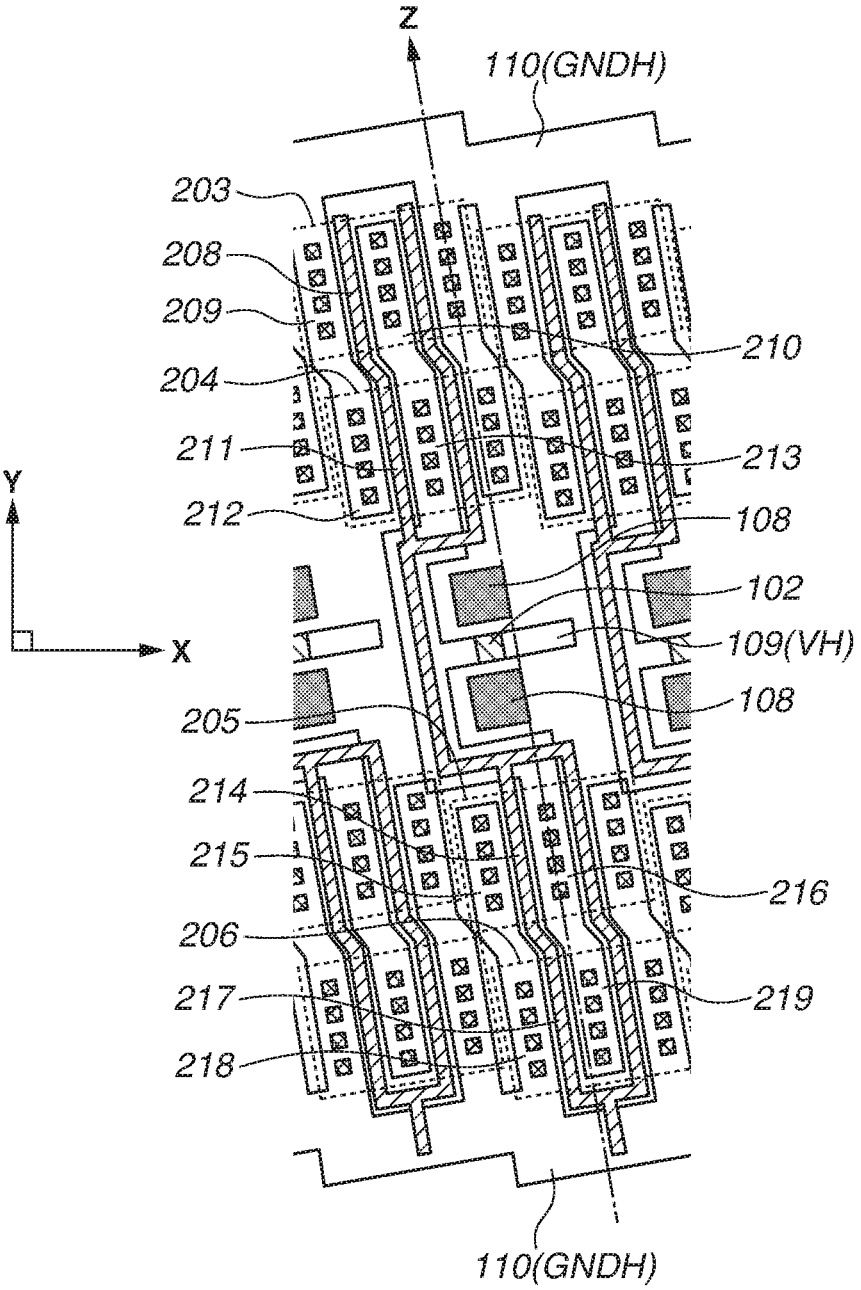
FIG. 10 is an enlarged view of a part of the liquid discharge head substrate illustrated in FIG. 9.

FIG. 10 is a plan view illustrating a layout around the heater 102 of the liquid discharge head substrate 1005 in an enlarged part 221 in FIG. 9. The circuit diagram is the same as that in FIG. 8-2. With this configuration, the space of the substrate 220 can be effectively used, and the liquid discharge head substrate can be downsized. Furthermore, the liquid discharge head substrate with a more efficient driving circuit can be provided. Thus, the cost reduction of the liquid discharge head can be achieved.

Figure 11:
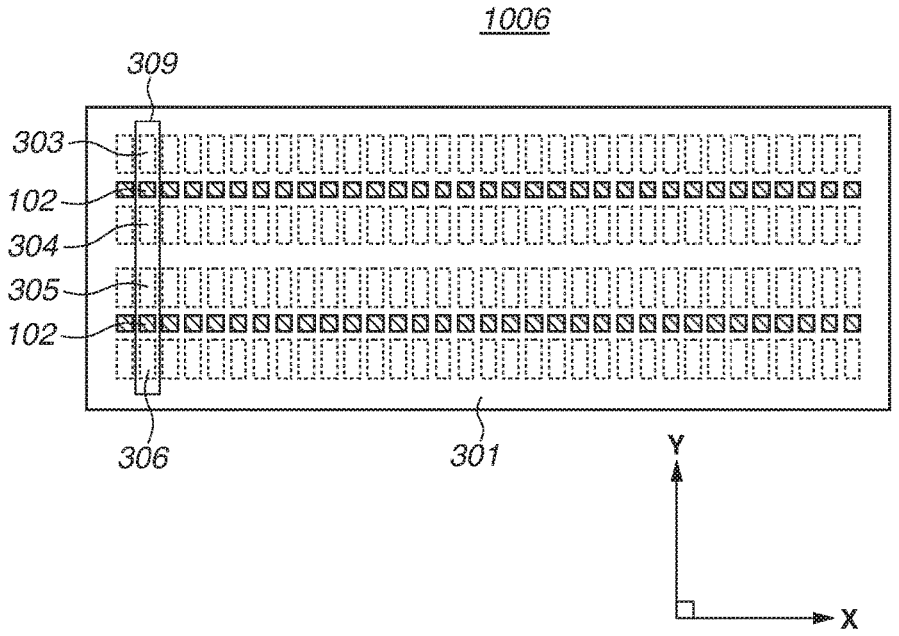
FIG. 11 is a diagram illustrating an example of a liquid discharge head substrate according to a sixth exemplary embodiment of the present invention.

FIG. 11 is a plan view of a liquid discharge head substrate 1006 forming a liquid discharge head according to a sixth exemplary embodiment of the present invention. The present exemplary embodiment is different from the first exemplary embodiment in that two heater rows each including the plurality of heaters 102 are arranged side by side in the Y-direction on a substrate 301. A first heater row (a first row of the heater rows) includes the heaters 102 each connected to transistors 303 and the transistors 304. A second heater row (a second row of the heater rows) includes the heaters 102 each connected to transistors 305 and the transistors 306.

The present exemplary embodiment is further different from the first exemplary embodiment in the circuit configuration. More specifically, a source follower circuit configuration including NMOS transistors and PMOS transistors is employed in the present exemplary embodiment. Thus, the driving circuit for the heater in the first heater row includes the transistor 303 as the NMOS transistor and the transistor 304 as the PMOS transistor. The driving circuit for the heater in the second heater row includes the transistor 305 as the PMOS transistor and the transistor 306 as the NMOS transistor.

In this exemplary embodiment, a difference from the first exemplary embodiment is described, and a description on the configuration and the effect that are the same as those in the first exemplary embodiment is omitted.

Figures 1, 12:
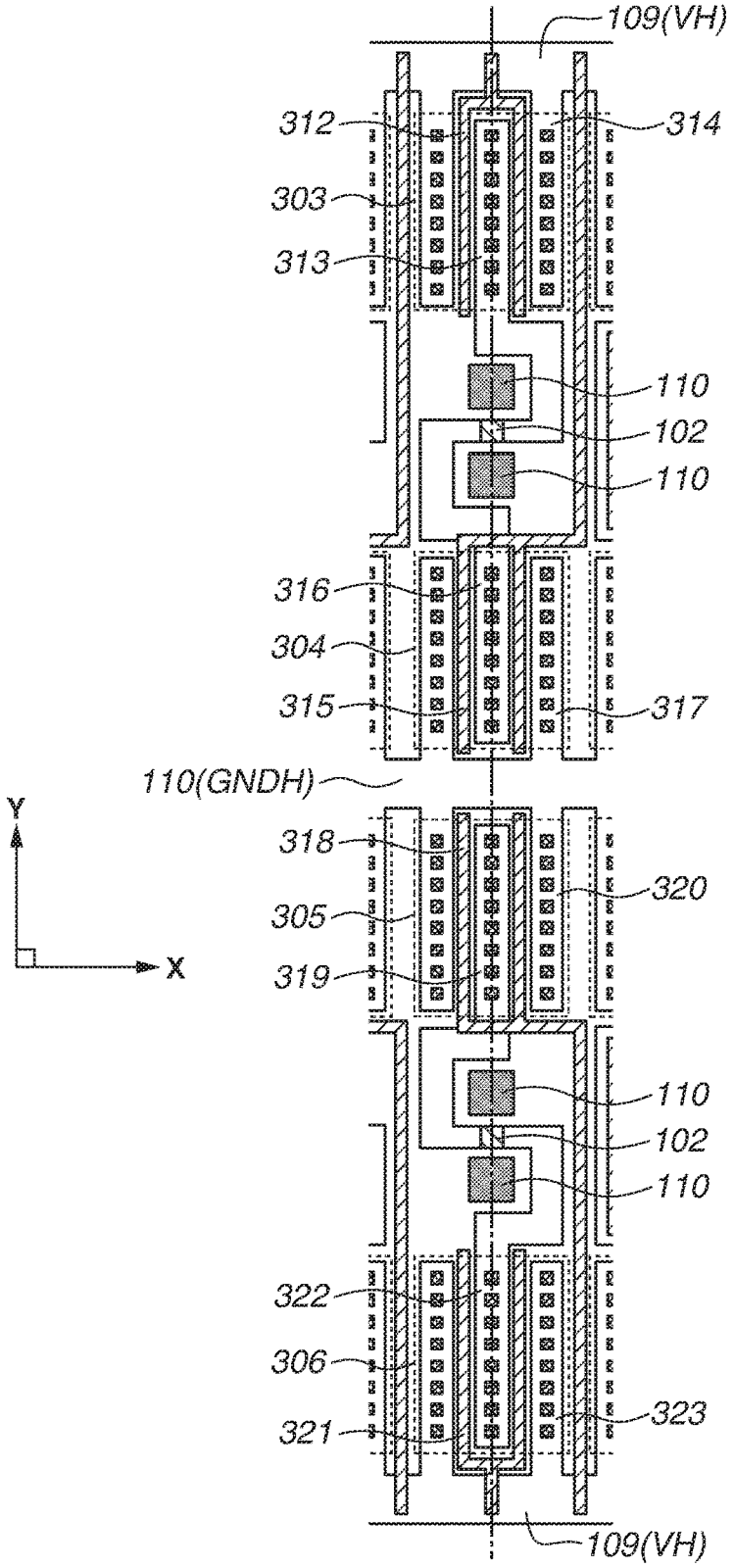
Figures 2, 12:
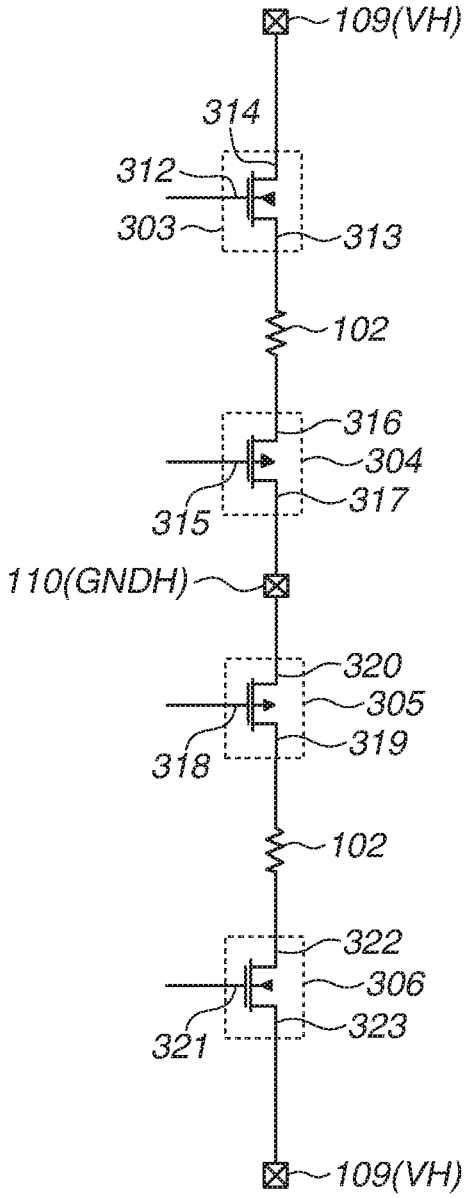

FIG. 12-1 is a plan view illustrating a layout around the heaters 102 of the liquid discharge head substrate 1006 in an enlarged part 309 in FIG. 11.

FIG. 12-2 is a circuit diagram illustrating an example of a part of the liquid discharge head substrate illustrated in FIG. 12-1. The heater 102 in the first row and the transistor 303 are connected in series on the electric path between the wiring 109 and the wiring 110. Similarly, the heater 102 in the second row and the transistor 304 are connected in series on the electric path between the wiring 109 and the wiring 110. In an example described in the present exemplary embodiment, the transistor 303, the heater 102, and the transistor 304 are connected in series on the electric path between the wiring 109 and the wiring 110. As illustrated in FIG. 12-2, this connection relationship between the wiring 109 and the wiring 110 similarly applies to the heater 102 in the second row.

More specifically, the wiring 109 (VH) is connected to drain wiring 314 of the transistor 303 and drain wiring 323 of the transistor 306. The heater 102 in the first row is connected to source wiring 313 of the transistor 303 and source wiring 316 of the transistor 304. In this exemplary embodiment, as in the other exemplary embodiments, the source region and the drain region may be respectively connected to the source wiring and the drain wiring directly or indirectly via another wiring, and the source wiring and the drain wiring may be connected to the wiring 109 and the wiring 110 directly or via wiring.

The heater 102 in the second row is connected to source wiring 319 of the transistor 305 and source wiring 322 of the transistor 306.

The transistor 304 and the transistor 305 respectively have drain wiring 317 and drain wiring 320 connected to the wiring 110 (GNDH). The transistor 303, the transistor 304, the transistor 305, and the transistor 306 respectively have gate electrodes 312, 315, 318, and 321 connected to a control circuit (not illustrated). In this example, the wiring 109 is connected to a power supply with a higher potential than the ground potential and the wiring 110 is grounded. However, this connection relationship regarding the potential can be reversed.

In FIG. 12-1, the transistor 303 and the transistor 304 are arranged such that the heater 102 is located between the transistor 303 and the transistor 304 in the Y-direction. When the NMOS transistor and the PMOS transistor are formed adjacent to each other, what is known as punch through involving current flowing from one transistor to the other occurs. Thus, the punch through needs to be prevented from occurring with the NMOS transistor and the PMOS transistor formed while being separated from each other. Unfortunately, this leads to a large area occupied by the driving circuit.

In the present exemplary embodiment, the transistor 303 as the NMOS transistor and the transistor 304 as the PMOS transistor are arranged such that the heater is located between the NMOS transistor and the PMOS transistor in the second direction. Thus, the layout can be designed without the risk of causing the punch through, whereby the liquid discharge head substrate can be downsized.

Similarly, the transistor 306 and the transistor 305 are arranged such that the heater 102 in the second row is located between the transistor 306 and the transistor 305, in the Y-direction. Thus, the transistor 306 as the NMOS transistor and the transistor 305 as the PMOS transistor can be arranged without the risk of causing the punch through, whereby the liquid discharge head substrate can be downsized.

The drain wiring 317 and the drain wiring 320 are connected to the common wiring 110 (GNDH) at the single location, whereby a layout area can be further reduced.

As described above, in the liquid discharge head substrate 1006 according to the present exemplary embodiment, the driving circuit is divided to be arranged on both sides of each of the first and the second heater rows extending in the first direction (X-direction). Thus, the layout area of the driving circuit can be reduced compared with the configuration where the driving circuit is arranged on one side. The liquid discharge head substrate with two heater rows can be further downsized with the two heater rows using a common terminal at the ground potential.

In the example described in the present exemplary embodiment, one of the transistors 303 and 304, which are arranged such that the heater 102 is located between the transistor 303 and the transistor 304, is the NMOS transistor and the other one is the PMOS transistor. However, the present invention is not limited to this example, and the transistors 303 and 304 may be of the same conductivity type.

In the present exemplary embodiment, the transistors 303 and 304 are linearly arranged on the second direction (Y-direction) orthogonal to the first direction in the plan view. However, the configuration according to an aspect of the present invention is not limited to this, and may employ the layout of the heater 102 and the transistors according to the second to the fifth exemplary embodiments.

For example, as in the second exemplary embodiment, the transistor 304 may be arranged with deviation in the X-direction (first direction) with respect to the transistor 303. The transistor 303 and the transistor 304 may be rotated about the heater 102 from the direction orthogonal to the X-direction as in the layout according to the third exemplary embodiment. The transistors 303 and 304 may each be divided into two transistors and the divided transistors may be arranged with deviation from each other in the X-direction, as in the layout according to the fourth exemplary embodiment. Furthermore, the layout obtained by the rotation about the heater 102 may be employed as in the fifth exemplary embodiment.

The substrate 301 may have a shape with four main sides as in any one of the second to the sixth exemplary embodiments. For example, the substrate 301 may have a parallelogram shape.

Figure 13:
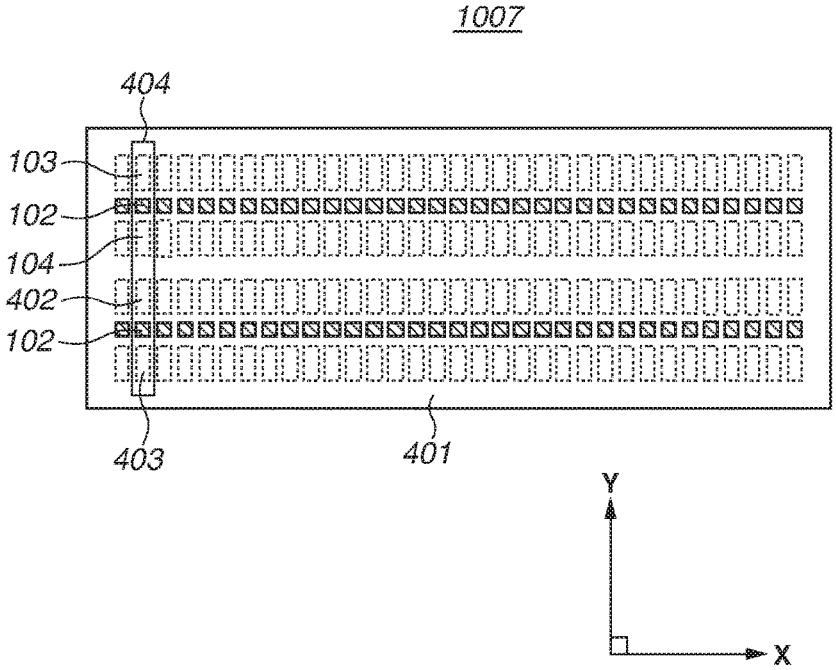
FIG. 13 is a diagram illustrating an example of a liquid discharge head substrate according to a seventh exemplary embodiment of the present invention.

FIG. 13 is a plan view of a liquid discharge head substrate 1007 forming a liquid discharge head according to a seventh exemplary embodiment of the present invention. The present exemplary embodiment is different from the first exemplary embodiment in that two rows of the plurality of heaters 102 are arranged on a substrate 401 with the heaters 102 in the second row connected to a transistor 402 and a transistor 403. The heaters 102 in the first row are connected to the transistors 103 and 104 as in the first exemplary embodiment. In this exemplary embodiment, a difference from the first exemplary embodiment is described, and a description on the configuration and the effect that are the same as those in the first exemplary embodiment is omitted.

Figures 1, 14:
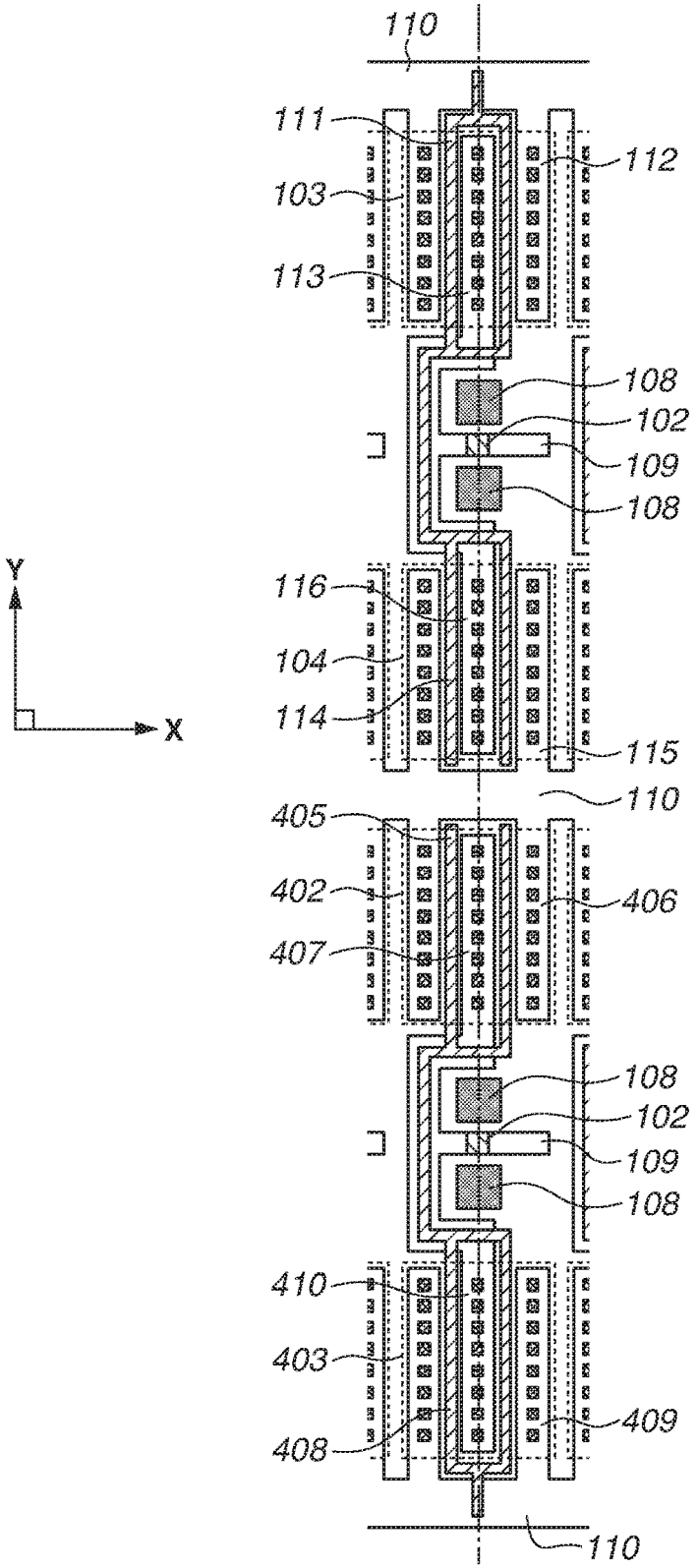
Figures 2, 14:
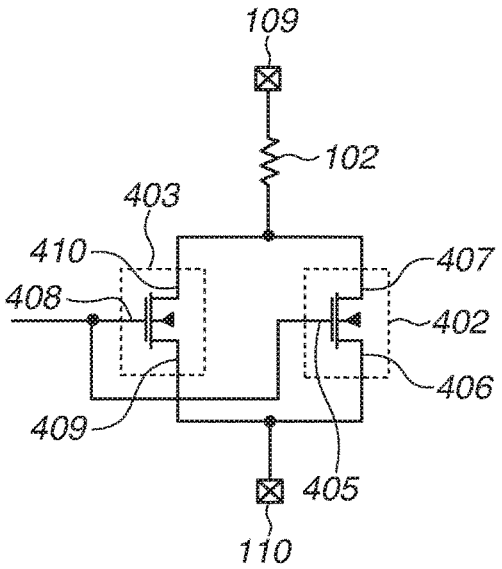

FIG. 14-1 is a plan view illustrating a layout around the heaters 102 in a liquid discharge head substrate 1007 in an enlarged part 404 in FIG. 13. FIG. 14-2 is a circuit diagram illustrating the heater 102 in the second row illustrated in FIG. 14-1 and the transistor 403 and the transistor 402 connected to this heater.

The transistor 403 and the transistor 402 are each an NMOS transistor. The heater 102 in the second row has one end connected to wiring 109 (VH) and the other end connected to drain wiring 410 of the transistor 403 and the drain wiring 407 of the transistor 402. Source wiring 409 of the transistor 403 and source wiring 406 of the transistor 402 are connected to the wiring 110 (GNDH). A gate electrode 408 of the transistor 403 and a gate electrode 405 of the transistor 402 are connected to a control circuit (not illustrated) through the same wiring.

In FIG. 14-1, the transistor 402 and the transistor 403 are arranged in such a manner that the heater 102 in the second row is positioned between the transistor 402 and the transistor 403 in the Y-direction (second direction). Thus, a current path with a small resistance can be achieved between the heater 102 in the second row and the most distant end of the drain region of the transistor 402 from the heater 102 and between the heater 102 and the most distance end of the drain region of the transistor 403 from the heater 102. The source wiring 115 and the source 406 are connected to the common wiring 110 (GNDH) at a single location, whereby a smaller layout area can be achieved.

With the driving circuit divided to be arranged on both sides of the heater 102 in the Y-direction, a liquid discharge head substrate with a more efficient driving circuit can be provided.

An eighth exemplary embodiment of the present invention where the liquid discharge head substrate is installed in a recording apparatus is described with reference to FIGS. 15A and 15B. Here, a recording apparatus employing an ink jet recording system is described as an example. However, the recording apparatus is not limited to this example. For example, the recording apparatus may employ a hot-melt or sublimation thermal transfer system. For example, the recording apparatus may be a single function printer that has a recording function only, or may be a multifunction printer that has a plurality of functions including the recording function, a FAX function, and a scanner function for example. For example, the recording apparatus may be a manufacturing apparatus for manufacturing a color filter, an electronic device, an optical device, a minute structure, and the like with a predetermined recording system.

The term "recording" not only includes a case where a visual representation such as an image, a mark, a pattern, and a structure that can be visually perceived by a person is formed on a recording medium, but also includes a case where a medium is processed. The "recording medium" not only includes paper used in general recording apparatuses, but also includes other objects on which a recording material can be attached such as a plastic film, a metal plate, glass, resin, wood, and leather. The "recording material" not only includes liquid such as ink to be attached on the recording medium for forming an image, a mark, a pattern, and the like or to be used for processing the recording medium, but also includes liquid used for processing the recording material (for example, for solidifying or insolubilizing a coloring material in the recording material).

Figure 15A:
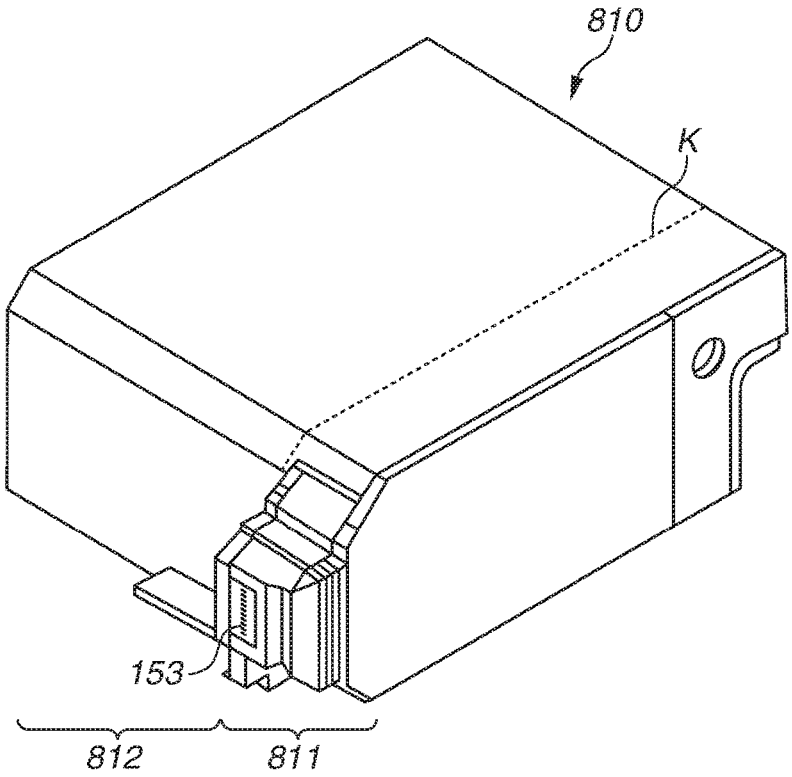
FIGS. 15A and 15B each illustrate an application example of a liquid discharge head substrate.

FIG. 15A illustrates an example of an outer view of a liquid discharge head 810. The liquid discharge head 810 may include a liquid discharge head 811 and an ink tank 812 attached to the liquid discharge head 811. The liquid discharge head 810 includes a liquid discharge head substrate and a plurality of nozzles 153 facing the liquid discharge head substrate. The liquid discharge head substrate may be the liquid discharge head substrate described in any one of the first to the seventh exemplary embodiments.

The ink tank 812 holds ink to be supplied to the liquid discharge head 811. The ink tank 812 and the liquid discharge head 811 may be separated from each other at a dotted line K for example, so that the ink tank 812 can be replaced.

The liquid discharge head 810 includes an electrical contact (not illustrated) for receiving an electric signal from a carriage 920 (FIG. 15B), and discharges the ink in accordance with the electric signal to perform the recording described above. The ink tank 812 includes a fibrous or porous ink holding member (not illustrated), and holds the ink with the ink holding member.

Figure 15B:
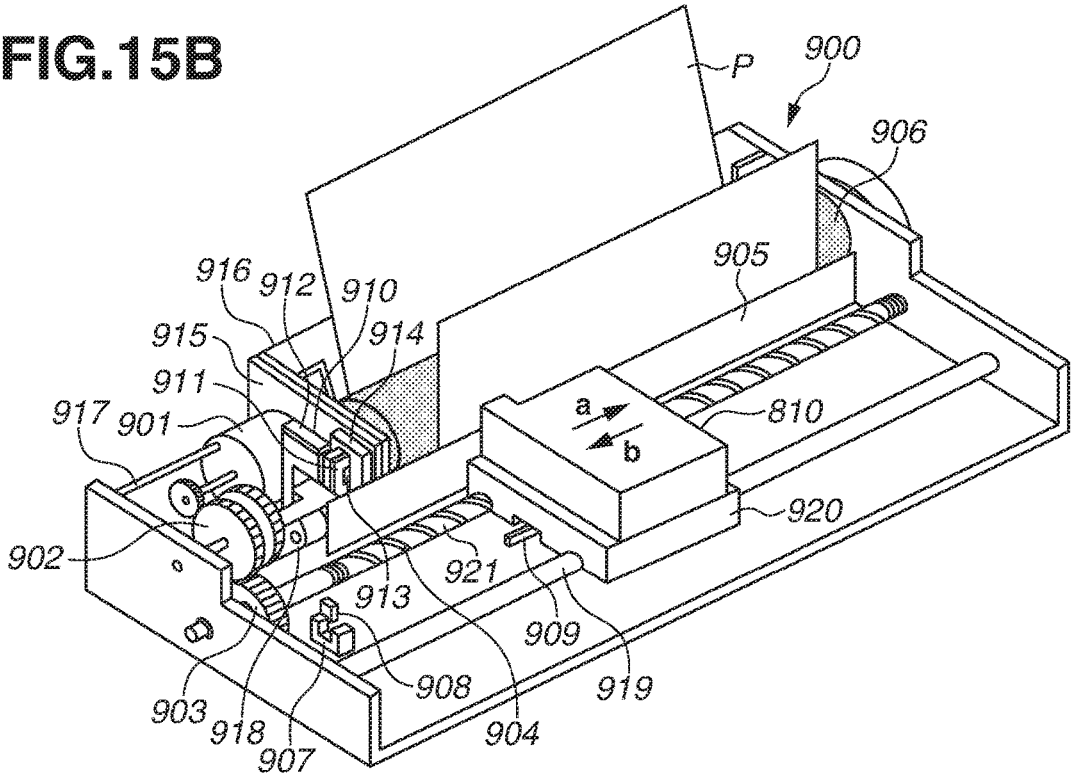

FIG. 15B is a bird's-eye view of a recording apparatus 900. The liquid discharge head 810 is the liquid discharge head partially illustrated in FIG. 15A, and may be installed on the carriage 920 together with the ink tank (recording material container). The carriage 920 may be attached to a lead screw 904 having a screw thread 921. When the lead screw 904 rotates, the liquid discharge head 810 may move, together with the carriage 920, in a direction indicated by an arrow a or b along a guide 919. The lead screw 904 is rotated in accordance with a rotation of a driving motor 901 via driving force transmission gears 902 and 903.

A recording sheet P may be conveyed onto a platen 906 by a conveyance unit (not illustrated). A sheet pressing plate 905 may press the recording sheet P against the platen 906 along the carriage movement direction. The recording apparatus 900 may use photocouplers 907 and 908 to check a position of a lever 909 provided to the carriage 920 and switch the rotation direction of the driving motor 901, or may perform the other like operation. A supporting member 910 may support a cap member 911 that caps the nozzles of the liquid discharge head 810. A suction unit 912 may perform suction inside the cap member 911 to execute suction recovery processing for the liquid discharge head 810 through a cap inner opening 913.

A cleaning blade 914 may be a known cleaning blade, and the cleaning blade 914 may be moved in a front and rear direction by a moving member 915. A main body supporting plate 916 may support the moving member 915 and the cleaning blade 914. A lever 917 may be provided for starting the suction recovery processing.

The lever 917 moves in accordance with a movement of a cam 918 engaged with the carriage 920. Driving force from the driving motor 901 may be controlled with a known transmission method such as clutch switching. The recording apparatus 900 is provided with a recording control unit (not illustrated). The recording apparatus 900 may control driving of each mechanism in accordance with an electric signal, such as recording data, from the outside. The recording apparatus 900 repeats reciprocation of the liquid discharge head 810 and conveyance of the recording sheet P with the conveyance unit (not illustrated), whereby the recording on the recording sheet P is completed.

The recording apparatus 900 may be used as an apparatus that stores 3D data and forms a three-dimensional image.

In the first, the second, the third, the fourth, the fifth, and the seventh exemplary embodiments, a source grounding configuration with the NMOS transistor provided between the heater 102 and the wiring 110 (GNDH) at the ground potential is employed. However, the driving circuit of the liquid discharge head substrate according to an aspect of the present invention is not limited to this configuration. For example, a source grounding configuration with the PMOS transistor arranged between the heater 102 and the wiring 109 (VH) (with the source connected to the wiring 109 connected to the power supply and the drain connected to the heater 102) may be employed.

In the first, the second, the third, the fourth, the fifth, and the seventh exemplary embodiments, the source grounding configuration with the NMOS transistor provided between the heater 102 and the wiring 110 is employed. Alternatively, a source follower configuration with the NMOS transistor (with the drain connected to the wiring 109 and the source connected to the heater 102) may be employed.

In the sixth exemplary embodiment, the source follower connection of the heater 102 and the NMOS transistor and the PMOS transistor is employed. Alternatively, a source grounding configuration (with a PMOS source connected to the wiring 109, PMOS and NMOS drains connected the heater 102, and a NMOS source connected to the wiring 110) may be employed.

In the sixth exemplary embodiment, the heaters 102 are arranged in two rows, but may be arranged in a single row or three rows or more.

In the second, the third, the fourth, and the fifth exemplary embodiments, the heaters 102 are arranged in a single row, but may be arranged in two rows, as in the sixth exemplary embodiment that is a two-row version of the first exemplary embodiment, or may be arranged in three rows or more.

In the fourth and the fifth exemplary embodiments, each of the transistors on both sides is divided into two transistors, e.g., the transistor 203 and the transistor 204, and the transistor 205 and the transistor 206. Alternatively, the transistor on only one side may be divided. The transistors may each be divided into three or may each be divided into a different number of transistors.

The transistors in the first to the seventh exemplary embodiments may have different shapes or may include a transistor.

The sixth exemplary embodiment may be modified and the transistors may be arranged with deviation in the X-direction, rotated from the Y-direction, or divided, as in the second to the fifth exemplary embodiments in which the first exemplary embodiment is modified.

While aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2016-086548, filed Apr. 22, 2016, which is hereby incorporated by reference herein in its entirety.

What is claimed is:

1. A liquid discharge head substrate comprising:

a first heater row including a plurality of heaters arranged in a first direction in a plan view; and a first transistor and a second transistor configured to supply current to a first heater of the plurality of heaters, wherein the first heater and the first transistor are connected in series on an electric path between first wiring to which a first potential is supplied and second wiring to which a second potential different from the first potential is supplied, wherein the first heater and the second transistor are connected in series on an electric path between the first wiring and the second wiring, and wherein the first heater is arranged between the first transistor and the second transistor in a second direction crossing the first direction in the plan view.

2. The liquid discharge head substrate according to claim 1, wherein the first transistor and the second transistor are connected in parallel on an electric path between the first wiring and the second wiring.

3. The liquid discharge head substrate according to claim 1, wherein the first transistor and the second transistor are of a same conductivity type.

4. The liquid discharge head substrate according to claim 3, wherein the first transistor and the second transistor are each an NMOS transistor.

5. The liquid discharge head substrate according to claim 1, wherein the first transistor and the second transistor are connected in series on an electric path between the first wiring and the second wiring.

6. The liquid discharge head substrate according to claim 1, wherein the first transistor and the second transistor are of different conductivity types.

7. The liquid discharge head substrate according to claim 1, wherein the first transistor and the second transistor each include a gate electrode, a source region, a drain region, and an active region overlapping with the gate electrode, and each have a channel width in a direction that is the second direction.

8. The liquid discharge head substrate according to claim 1, wherein the liquid discharge head substrate has a shape with four main sides including a pair of parallel sides, and wherein an angle between one of the pair of parallel sides and one of other two sides is an acute angle and an angle between another one of the pair of parallel sides and another one of the other two sides is an obtuse angle, or an angle between an extension line of one of the pair of parallel sides and an extension line of one of the other two sides is an acute angle and an angle between an extension line of another one of the pair of parallel sides and an extension line of another one of the other two sides is an obtuse angle.

9. The liquid discharge head substrate according to claim 8, wherein the second direction is orthogonal to the first direction.

10. The liquid discharge head substrate according to claim 8, wherein the second direction is not orthogonal to the first direction.

11. The liquid discharge head substrate according to claim 1, wherein the second transistor is arranged with deviation in the first direction with respect to the first transistor.

12. The liquid discharge head substrate according to claim 1, further comprising a plurality of supply ports arranged in the first direction in the plan view.

13. The liquid discharge head substrate according to claim 1, wherein one of the plurality of supply ports is arranged between the first transistor and the second transistor in the second direction in the plan view.

14. The liquid discharge head substrate according to claim 1, further comprising:

a third transistor connected to the first transistor; and a fourth transistor connected to the second transistor, wherein the first transistor, the first heater, and the second transistor are arranged between the third transistor and the fourth transistor in the second direction.

15. The liquid discharge head substrate according to claim 1, further comprising:

a second heater row including a plurality of heaters arranged in the first direction;

a fifth transistor configured to drive a second heater of the plurality of heaters; and a sixth transistor configured to drive the second heater, wherein the second heater is arranged between the fifth transistor and the sixth transistor in the second direction crossing the first direction, and wherein the first heater row and the second heater row are arranged side by side in the second direction.

16. The liquid discharge head substrate according to claim 1, wherein the liquid discharge head substrate has a shape with four main sides including a pair of parallel sides, wherein an angle between one of the pair of parallel sides and one of other two sides is an acute angle and an angle between another one of the pair of parallel sides and another one of the other two sides is an obtuse angle, or an angle between an extension line of one of the pair of parallel sides and an extension line of one of the other two sides is an acute angle and an angle between an extension line of another one of the pair of parallel sides and an extension line of another one of the other two sides is an obtuse angle, and wherein the second transistor is arranged with deviation in the first direction with respect to the first transistor.

17. The liquid discharge head substrate according to claim 16, further comprising a plurality of supply ports arranged in the first direction in the plan view.

18. The liquid discharge head substrate according to claim 17, wherein one of the plurality of supply ports is arranged between the first transistor and the second transistor in the second direction in the plan view.

19. A liquid discharge head comprising:

a plurality of nozzles; and a liquid discharge head substrate facing the plurality of nozzles, the liquid discharge head substrate including:

a first heater row including a plurality of heaters arranged in a first direction in a plan view; and a first transistor and a second transistor configured to supply current to a first heater of the plurality of heaters, wherein the first heater and the first transistor are connected in series on an electric path between first wiring to which a first potential is supplied and second wiring to which a second potential different from the first potential is supplied, wherein the first heater and the second transistor are connected in series on an electric path between the first wiring and the second wiring, and wherein the first heater is arranged between the first transistor and the second transistor in a second direction crossing the first direction in the plan view.

20. A recording apparatus comprising:

a liquid discharge head including a plurality of nozzles and a liquid discharge head substrate facing the plurality of nozzles, the liquid discharge head substrate having:

a first heater row including a plurality of heaters arranged in a first direction in a plan view; and a first transistor and a second transistor configured to supply current to a first heater of the plurality of heaters, wherein the first heater and the first transistor are connected in series on an electric path between first wiring to which a first potential is supplied and second wiring to which a second potential different from the first potential is supplied, wherein the first heater and the second transistor are connected in series on an electric path between the first wiring and the second wiring, and wherein the first heater is arranged between the first transistor and the second transistor in a second direction crossing the first direction in the plan view; and an ink tank attached to the liquid discharge head.

* * * * *